US009888819B2

(12) United States Patent
Jang et al.

(10) Patent No.: US 9,888,819 B2
(45) Date of Patent: Feb. 13, 2018

(54) ROBOT CLEANER

(71) Applicant: LG Electronics Inc., Seoul (KR)

(72) Inventors: Jaewon Jang, Seoul (KR); Sungil Park, Seoul (KR); Jongsu Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 606 days.

(21) Appl. No.: 14/079,053

(22) Filed: Nov. 13, 2013

(65) Prior Publication Data

US 2014/0130290 A1 May 15, 2014

(30) Foreign Application Priority Data

Nov. 14, 2012 (KR) ..... 10-2012-0128560

(51) Int. Cl.
*A47L 9/28* (2006.01)
*A47L 9/10* (2006.01)

(52) U.S. Cl.
CPC ..... *A47L 9/108* (2013.01); *A47L 2201/00* (2013.01)

(58) Field of Classification Search
None
See application file for complete search history.

(56) References Cited

U.S. PATENT DOCUMENTS 5,111,247 A * 5/1992 Nichols ..... G03G 15/0849 366/142
2005/0183406 A1* 8/2005 Coburn ..... A47L 5/24 55/502
2007/0061040 A1* 3/2007 Augenbraun ..... A47L 5/225 700/245
2009/0044370 A1* 2/2009 Won ..... A47L 9/106 15/319
2010/0229331 A1* 9/2010 Kang ..... A47L 9/108 15/347

FOREIGN PATENT DOCUMENTS

CN 1653999 A 8/2005
CN 101297267 A 10/2008
CN 201641878 U 11/2010
CN 101961221 A 2/2011
CN 101961227 * 2/2011
CN 101961227 A 2/2011
(Continued)

OTHER PUBLICATIONS

English Translation of CN 101961227 from Espacenet.*

*Primary Examiner* — Joseph J Hail
*Assistant Examiner* — Brian Keller
(74) *Attorney, Agent, or Firm* — Dentons US LLP

(57) ABSTRACT

A robot cleaner includes a body forming an external appearance of the robot cleaner, a body moving part provided to the body to move the body, a body driving unit to drive the body moving part, a dust collector to capture suctioned foreign substances and provided with a first chamber and a second chamber communicating with the first chamber, a suction generation unit to supply suction force to the dust collector, and a guide member to guide the foreign substances captured in the first chamber to the second chamber and to apply pressure to the foreign substances in the second chamber in order to compress the foreign substances.

15 Claims, 6 Drawing Sheets

(56) References Cited

FOREIGN PATENT DOCUMENTS

| | | | |
|---|---|---|---|
| EP | 2417893 | A1 | 2/2012 |
| JP | S54-114359 | | 1/1978 |
| JP | 6-105764 | A | 4/1994 |
| KR | 10-0809773 | B1 | 3/2008 |
| WO | 2011-074716 | A1 | 6/2011 |

* cited by examiner

ROBOT CLEANER

This application claims the benefit of the Korean Patent Application No. 10-2012-0128560, filed on Nov. 14, 2012, which is hereby incorporated by reference as if fully set forth herein.

BACKGROUND

Field of the Disclosure

The present disclosure relates to a robot cleaner, and more particularly to a robot cleaner which is capable of collecting and compressing captured foreign substances.

Background

In general, robots have been developed for industrial use and have played a role in factory automation. Recently, robots have begun to be applied to a rapidly increasing variety of applications. For example, medical robotics and aerospace robotics are active areas of research. In addition, domestic robots, which can be used in homes, are being manufactured.

A representative example of a domestic robot is a robot cleaner. The robot cleaner autonomously travels about a certain region, performing a cleaning function by suctioning dust and foreign substances from the surroundings.

The robot cleaner is typically provided with a rechargeable battery, and an obstacle detection sensor which allows the robot cleaner to avoid obstacles while traveling. Thereby, the robot cleaner is capable of autonomously traveling and performing cleaning operation.

Such a robot cleaner includes a casing forming the external appearance of the robot cleaner and are provided with a suction port through which dust or foreign substances are suctioned, a wheel provided to the casing, a drive motor to drive the wheel, a dust collection container to collect the dust and foreign substances, and a suction motor connected to the dust collection container.

Robot cleaners are generally battery-powered. Accordingly, robot cleaners are typically designed to be lightweight so as to increase energy efficiency and to be small in height such that they can clean underneath furniture or structures.

Accordingly, the dust collection container of a robot cleaner is smaller in volume than that of a common vacuum cleaner. Due to the repetitive cleaning operation, the dust collection container of a robot cleaner having a small volume frequently becomes full, and dust accumulated between the suction port and a filter lowers suction force.

Thereby, a user may need to more frequently remove the dust collection container from the robot cleaner to dump the dust collected in the dust collection container than in the case of a common cleaner.

SUMMARY

Accordingly, the present disclosure is directed to a robot cleaner that substantially obviates one or more problems due to limitations and disadvantages discussed above.

One object is to provide a robot cleaner whose cleaning efficiency is not degraded even when a dust collector is used for a long period of time without being cleaned.

Embodiments of the present invention provide a robot cleaner which minimizes scattering of foreign substances in cleaning the dust collector by compressing the foreign substances in the dust collector, and is thus convenient to use.

Embodiments of the present invention is to provide a robot cleaner which has a flow path less interfered with by foreign substances suctioned into the robot cleaner and may prevent clogging of a filter.

Embodiments of the present invention is to provide a robot cleaner which may enhance reliability of operation of a dust sensor by removing foreign substances accumulated in the dust sensor.

Additional advantages, objects, and features may be set forth in part in the description which follows and in part will become apparent to those having ordinary skill in the art upon examination of the following or may be learned from practice of the invention. The objectives and other advantages may be realized and attained by the structure particularly pointed out in the written description and claims hereof as well as the appended drawings.

According to one aspect, a robot cleaner includes a body forming an external appearance of the robot cleaner, a dust collector to capture suctioned foreign substances, a suction generation unit to provide suction force to the dust collector, and a guide member to guide movement of the foreign substances suctioned into the dust collector, wherein the dust collector includes a first chamber to primarily capture the foreign substances, and a second chamber communicating with the first chamber, wherein, when operation of the suction unit is stopped, the guide member rotates to guide the foreign substances captured in the first chamber to the second chamber.

In another aspect, a robot cleaner includes a body forming an external appearance of the robot cleaner, a body moving part provided to the body to move the body, a body driving unit to drive the body moving part, a dust collector to capture suctioned foreign substances and provided with a first chamber and a second chamber communicating with the first chamber, a suction generation unit to supply suction force to the dust collector, and a guide member to guide the foreign substances captured in the first chamber to the second chamber and to apply pressure to the foreign substances in the second chamber in order to compress the foreign substances.

Preferably, the guide member is rotatably arranged in the first chamber, and guide and pressurization of the foreign substances are performed by rotation of the guide member.

Herein, the first chamber may be a space to primarily accommodate the suctioned foreign substances, and the foreign substances accommodated in the first chamber may be stored in the second chamber. That is, the foreign substances suctioned into the first chamber of the dust collector may be guided to the second chamber and stored in the second chamber in a relatively stable state.

Accordingly, the first chamber may be a part of a flow path into which the foreign substances are introduced. Therefore, the foreign substances naturally fluctuate in the first chamber during operation of the suction generation unit. On the other hand, the second chamber may be arranged spaced apart from the first chamber or the flow path while communicating with the first chamber or the flow path. Thereby, the foreign substances stored in the second chamber may remain in a relatively stable state during operation of the suction generation unit.

More specifically, the foreign substances in the second chamber may be pressurized and compressed by the guide member. This means that a large amount of foreign substances in the second chamber may be massed into a lump. Accordingly, the foreign substances in the second chamber are allowed to remain stored in a relatively stable state during operation of the suction generation unit.

A reducer assembly may be provided and installed to one side of the dust collector to be coupled to the guide member to supply driving force causing the guide member to rotate.

Preferably, a through hole allowing foreign substances to be suctioned into the dust collector from an exterior of the body is formed in the first chamber, wherein the first chamber is provided with an opening and closing member to open and close the through hole. Preferably, the opening and closing member opens the through hole according to suction force produced during operation of the suction generation unit, and closed the through hole by gravity when the operation of the suction generation unit is stopped. With this opening and closing member, discharge of the foreign substances from the dust collector to the outside through the through hole may be prevented even if the dust collector is separated from the body. That is, unintentional discharge of the foreign substances from the dust collector through the through hole may be prevented.

The first chamber may be provided with a communication hole allowing introduced air to be discharged from the dust collector to the suction generation unit therethrough.

Preferably, the communication hole is provided with a pre-filter, and a filter unit is provided between the pre-filter and the suction generation unit.

The pre-filter or the communication hole is preferably formed of a mesh having a plurality of holes. By the pre-filter or the communication hole, relatively large foreign substances may be filtered out and accommodated in the first chamber.

The guide member may be arranged to contact the pre-filter or the communication hole when driven to rotate, and the foreign substances stuck to the pre-filter or the communication hole are separated by the contact. That is, the guide member preferably sweeps out foreign substances stuck to the pre-filter or the communication hole like a broom. Thereby, smooth air flow through the pre-filter or the communication hole may be allowed. This may in turn prevent weakening of the suction force from the suction generation unit.

The guide member preferably includes a rotating shaft, and a plate to rotate about the rotating shaft in the first chamber.

An overall inner space of the first chamber may have a cylindrical form, and the rotating shaft may be arranged in a longitudinal direction of the cylindrical form. More specifically, the rotating shaft may be horizontally arranged with respect to the ground.

The plate may be formed to extend from the rotating shaft in a radial direction or a direction of radius of the rotating shaft. Thereby, foreign substances positioned at the interior or inner wall of the first chamber may be guided to the second chamber by rotation of the plate.

Preferably, the dust collector may include a step disposed between the first chamber and the second chamber and protrudes to rise to a predetermined height, and the step forms a boundary between the first chamber and the second chamber while allowing the first chamber and the second chamber to communicate with each other.

The end tip of the plate is preferably introduced into the second chamber beyond the step by rotating the rotating shaft such that the foreign substances captured in the first chamber are guided to the second chamber, and that the foreign substances in the second chamber are pressurized and compressed. That is, the plate serves to temporarily reduce the inner space of the second chamber by rotating. Accordingly, as the amount of foreign substances in the inner space of the second chamber increases, the foreign substances may be further closely compressed.

This compression may reduce distances between the foreign substances, minimizing the area of contact with the flow of air.

The first chamber may be provided with a dust sensor to determine the amount of suctioned foreign substances or the amount of captured foreign substances.

The guide member may be driven when the amount of foreign substances measured by the dust sensor exceeds a predetermined amount.

When the amount of foreign substances flowing in the first chamber becomes large, the guide member may be operated through the dust sensor. In this case, the frequency of operation of the guide member may be increased. In the case that the amount of the suctioned foreign substances exceeds the predetermined amount, it may be viewed that the amount of the suctioned foreign substances is large, and the guide member may operate. In addition, the frequency of operations of the guide member may be increased.

A brush to remove the foreign substances attached to the dust sensor may be arranged on a lateral surface of the guide member. For example, the dust sensor may be a sensor utilizing light. Accordingly, in the case that foreign substances are attached to the sensor, reliability of the sensor may be degraded. To prevent this degradation, the foreign substances attached to the sensor are preferably removed through rotation of the guide member.

Preferably, the dust collector is detachably mounted to a back of the body. That is, the first chamber and the second chamber to accommodate foreign substances are integrally and detachably mounted to the back of the body.

Preferably, the first chamber includes a through hole formed at a front lower side of the first chamber to allow foreign substances to be suctioned into the dust collector from an exterior of the body, and a communication hole formed at a front upper side of the first chamber to allow air introduced into the first chamber to be discharged to the suction generation unit therethrough, wherein the second chamber may communicate with the first chamber through a rear side of the first chamber.

The guide member is preferably driven to rotate from a predetermined initial position and return to the initial position. For example, the guide member may be rotated 360 degrees or an integer times 360 degrees. That is, when rotated, the guide member may preferably complete at least one rotation and stop at the initial position.

Herein, the initial position may be preset in relation to the through hole, the communication hole, and the portions of the first and second chambers which communicate with each other. Specifically, the initial position is preferably preset to a portion out of the area between the through hole and the communication hole. This is intended to prevent the guide member at the initial position from interfering with suction of foreign substances and discharge of air during operation of the suction generation unit, It is to be understood that both the foregoing general description and the detailed description to follow are exemplary and explanatory and are intended to provide further explanation of the disclosure.

BRIEF DESCRIPTION OF THE DRAWINGS

The accompanying drawings, which are included to provide a further understanding of the disclosure and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Figure 1:
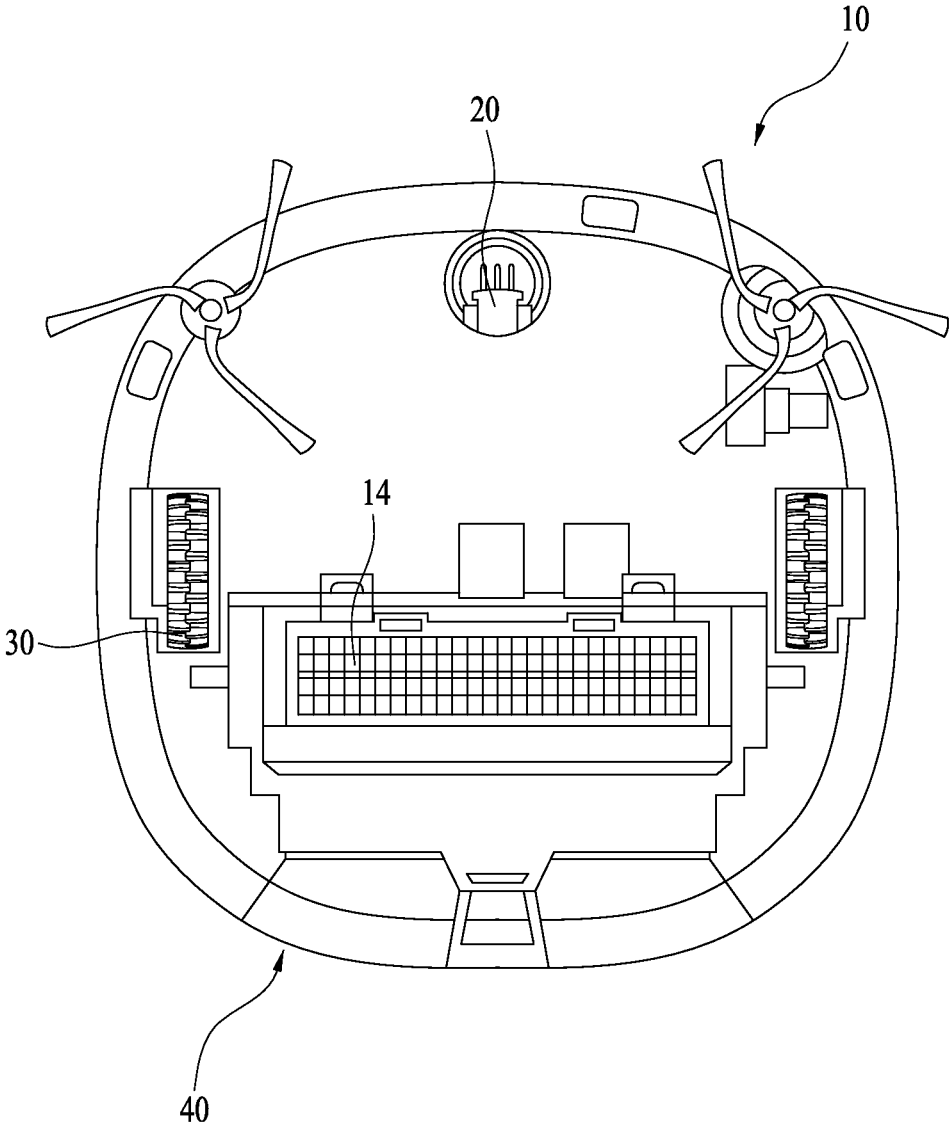
FIG. 1 is a view showing a lower surface of a robot cleaner according to an embodiment of the present invention.

Reference will now be made in detail to the preferred embodiments of the present invention, examples of which are illustrated in the accompanying drawings. Wherever possible, the same reference numbers may be used throughout the drawings to refer to the same or like parts.

The sizes and shapes of constituents shown in the drawings may be exaggerated for clear and easy description. In addition, the terms specifically defined in consideration of the configuration and operation of the embodiments of the present invention may be differently defined according to intention of a user or operator or custom. These terms should be defined based on the entire context of this specification.

FIG. 1 is a view showing a lower surface of a robot cleaner according to an embodiment of the present invention. A description is given below with reference to FIG. 1.

The robot cleaner is provided with a body 10 forming an external appearance of the robot cleaner, and body moving parts 30 and 20 arranged at the body 10 to move the body 10. The body moving parts may include main wheels 30 to move the body 10 back and forth or rotate to allow rotation of the body 10, and an auxiliary front wheel 20 to support one side of the body 10 and assist the main wheels 30 in moving back and forth and rotating the body 10.

Herein, the main wheels 30 are independently arranged at the left and right sides of the body 10 such that each of the main wheels 30 on the left and right sides of the body 10 may be independently driven. For example, the main wheels 30 may be driven by different motors. That is, the robot cleaner may include a body driving unit to drive the body moving parts. Specifically, the body driving unit may include a motor. The motor may be arranged to drive the body moving parts, particularly, the main wheels 30.

The body 10 is provided with an agitator 14 capable of striking foreign substances during rotation thereof. The agitator 14 strikes the surface to be cleaned to separate foreign substances stuck to the surface from the surface, while contacting the surface.

In addition, the agitator 14 may guide, while rotating, the foreign substances separated from the surface to be cleaned such that the foreign substances may be suctioned into the body 10.

Meanwhile, the main wheels 30 include two wheels arranged on both sides of the body 10. The two wheels may rotate at different rates of rotation or in different directions of rotation such that the body 10 turns left or right. Accordingly, when the body 10 encounters an object, the travel direction of the body 10 may be changed by driving the main wheels 30.

A dust collector 40 may be detachably provided to the rear side of the body 10. When the foreign substances are collected in the dust collector 40, the user may remove the dust collector 40 from the body 10 to dump out the foreign substances accommodated in the dust collector 40.

Figure 2:
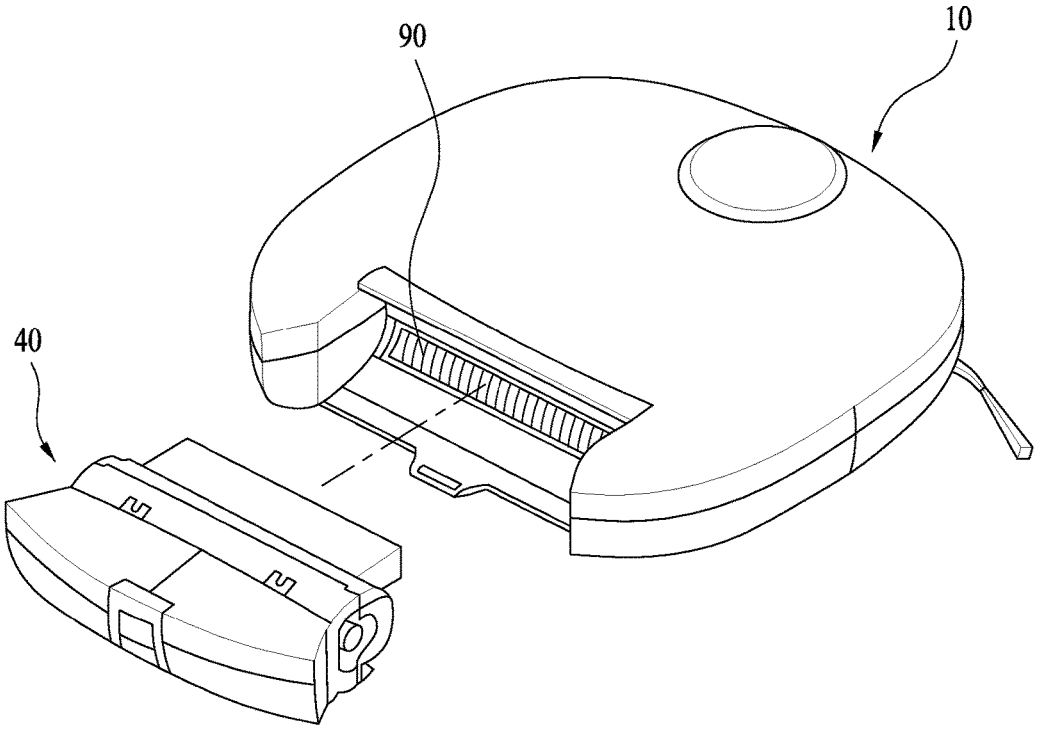
FIG. 2 is a view showing the robot cleaner and a dust collector separated from the robot cleaner according to an embodiment of the present invention.

FIG. 2 is a view showing the robot cleaner and a dust collector separated from the robot cleaner according to an embodiment of the present invention. Hereinafter, a description will be given with reference to FIG. 2.

Preferably, the dust collector 40 is a constituent that can be removed from a rear of the body 10. When the dust collector 40 is coupled to the body 10, it may be installed to contact a filter 90 provided in the body 10. The filter 90 may remain in the body 10 when the dust collector 40 is separated from the body 10. The filter 90 may be individually separated from the body 10 for cleaning or replacement.

The foreign substances suctioned into the robot cleaner are collected in the dust collector 40, and the suctioned air is discharged to an outer space through the body 10. At this time, the foreign substances suctioned into the dust collector 40 may not pass through the filter 90, but remain accommodated in the dust collector 40.

Figure 3:
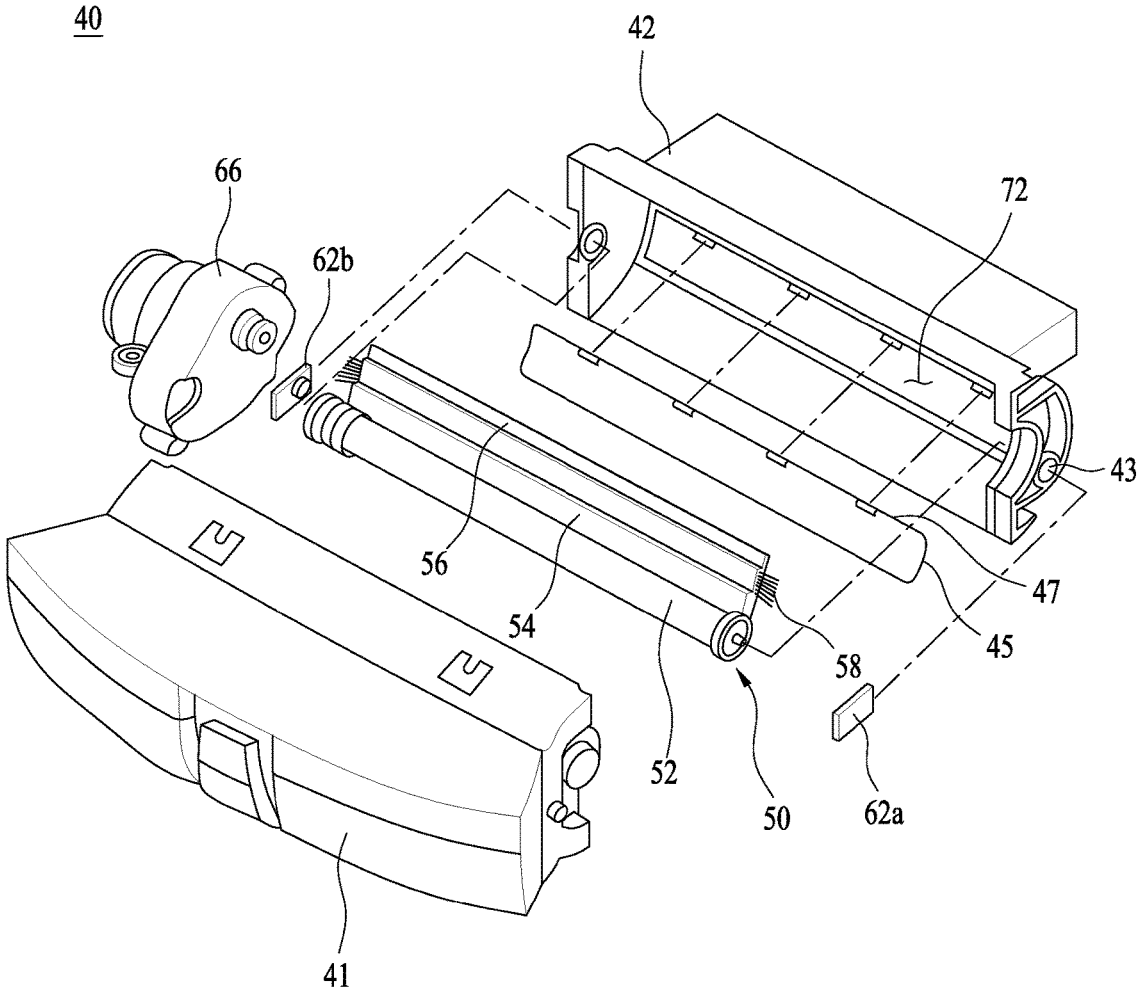
FIG. 3 is an exploded perspective view showing the dust collector according to an embodiment of the present invention.

FIG. 3 is an exploded perspective view showing the dust collector according to an embodiment of the present invention. Hereinafter, a description will be given below with reference to FIG. 3.

The dust collector 40 may include a dust collector body 41 forming an external appearance of the back of the dust collector 40, and a dust collector cover 42 coupled to the dust collector body 41 to define a predetermined space therein. The dust collector body 41 and the dust collector cover 42 may be coupled to each other to define a space to accommodate foreign substances.

The inner space defined by the dust collector body 41 and the dust collector cover 42 may be generally formed in the shape of two overlapping cylinders. Thereby, a first chamber 70 may be formed as described below. In addition, a second chamber 80 may be arranged near the first chamber 70. The two spaces, i.e., the first chamber 70 and the second chamber 80 communicate with each other such that air and foreign substances may move therein.

The robot cleaner may be provided with a guide member 50 to guide foreign substances suctioned into the dust collector 40. The guide member 50 may apply force to the foreign substances suctioned into the dust collector 40 such that the foreign substances move to a particular location. Specifically, the guide member 50 may be arranged to guide the foreign substances such that the foreign substances move from one location to another location. More specifically, the guide member 50 may be arranged to guide the foreign substances collected in the first chamber 70 to the second chamber 80. Herein, the first chamber 70 and the second chamber 80 preferably communicate with each other. As disclosed below, the guide member may be arranged to apply pressure to the foreign substances in the second chamber 80. That is, the guide member preferably applies pressure to the foreign substances stored in the second chamber 80 to compress the foreign substances.

A through hole 72 through which the foreign substances struck by the agitator 14 are suctioned and moved into the dust collector 40 may be formed in the dust collector cover 42. The through hole 72 may be provided at a lower side of the dust collector cover 42, and thereby foreign substances may be easily suctioned from the surface to be cleaned.

Preferably, an opening and closing member 45 to open and close the through hole 72 is installed at the inside of the dust collector cover 42. The opening and closing member 45 may be formed in the shape of a thin plate having a predetermined weight. Particularly, the opening and closing member 45 may have a predetermined curvature to correspond to the curved shape of the through hole 72.

The opening and closing member 45 is provided with a fixed end 47 rotatably installed at the inside of the dust collector cover 42 and the other end to be movable with respect to the dust collector cover 42. Accordingly, the opening and closing member 45 may close the through hole 72 by gravity. In the case that force is applied to pull the opening and closing member 45 into the dust collector cover 42, the opening and closing member 45 rotate by the fixed end 47 into the dust collector cover 42 to open the through hole 72 since the fixed end 47 is fixed to the inside of the dust collector cover 42.

In addition, the guide member 50 is preferably arranged to be rotatable in the dust collector 40. Further, guiding and applying pressure to the foreign substances are preferably performed by rotation of the guide member 50.

The guide member 50 includes a rotating shaft 52 and a plate 54 to rotate with the rotating shaft 52. The plate 54 may have a predetermined thickness and extend from the rotating shaft 52 in a radial direction or the direction of radius.

Herein, the rotating shaft 52 may be installed at one side of the space defined by the dust collector 40, thereby moving foreign substances captured through rotation of the plate 54 to the opposite side of the space. That is, the rotating shaft 52 is preferably arranged in the first chamber 70, and the foreign substances collected in the first chamber 70 are preferably moved to the second chamber 80 by rotation of the plate 54.

A squeegee 56 may be installed at the tip of the plate 54. Herein, the squeegee 56 may further extend in a radial direction or the direction of radius with respect to the rotating shaft 52 to contact the inner surface of the space accommodated in the dust collector 40 and to move the foreign substances therefrom. Specifically, the squeegee 56 may move foreign substances while contacting the inner surface of the first chamber 70. Preferably, the squeegee 56 is formed of a deformable material such as rubber such that contact between the squeegee 56 and the inner space of the dust collector 40 may be maintained even when the plate 54 completes multiple rotations.

A brush 58 may be installed on both sides of the plate 54 to be parallel with the rotating shaft 52. That is, the brush 58 may be installed to be perpendicular to the squeegee 56 to remove foreign substances suck to the side inner space of the dust collector 40.

The brush 58 may be formed of the same material as that of the squeegee 56, or may be provided with a plurality of protruding strips. In addition to removing foreign substances, the brush 58 may be used to clean a dust sensor, as described below.

Meanwhile, the dust collector 40 may include a reducer assembly 66 installed at one side of the dust collector 40 and coupled to the guide member 50 to provide driving power to rotate the guide member 50. The reducer assembly 66 may use the driving power produced by the motor installed at the body 10 to rotate the plate 54 in a manner that the rate of rotation of the motor is reduced and transferred to the plate 54.

The reducer assembly 66 may be configured with a plurality of gears or pulleys to reduce the rate of rotation of the motor.

The dust collector 40 may be provided therein with a dust sensor 62 to determine suction of foreign substances. Herein, the dust sensor 62 may be installed to adjoin the through hole 72 to determine suction of dust into the through hole 72. In addition, the dust sensor 62 may determine the amount of suctioned dust or the amount of collected foreign substances. Specifically, the dust sensor may be arranged to determine the amount of foreign substances suctioned into the first chamber 70 or the amount of foreign substances collected in the first chamber 70.

The dust sensor 62 may be installed at a sensor window 43 provided to the dust collector cover 42. Herein, the sensor window 43 is formed at opposite sides of the dust collector cover 42 in the same form, as shown in FIG. 3. The sensor window 43 may be installed at the lower end of the dust collector cover 42 where the through hole 72 is formed, or may be installed at any other position adjacent to the through hole 72.

The sensor window 43 may define an opening such that the dust sensor 62 is exposed to the inner space of the dust collector 40. On the other hand, the sensor window 43 may be formed of a transparent material so as not to influence transmission of light to or from the dust sensor 62.

The dust sensor 62 may include an optical sensor which uses visible light, or an infrared sensor.

The dust sensor 62 may include a dust sensor transmitter 62*a* and a dust sensor receiver 62*b* to receive light transmitted from the dust sensor transmitter 62*a*. The dust sensor transmitter 62*a* and the dust sensor receiver 62*b* are installed to sense the inner space of the dust collector 40. The dust sensor transmitter 62*a* may be arranged at one side in the dust collector 40, and the dust sensor receiver 62*b* may be arranged at the opposite side in the dust collector 40. In this case, if light is received, the dust sensor receiver 62*b* may determine that dust has not been suctioned into the dust collector 40. If the amount of received light is low, the dust sensor receiver 62*b* may determine that a small amount of dust is being suctioned into the dust collector 40.

Figure 4:
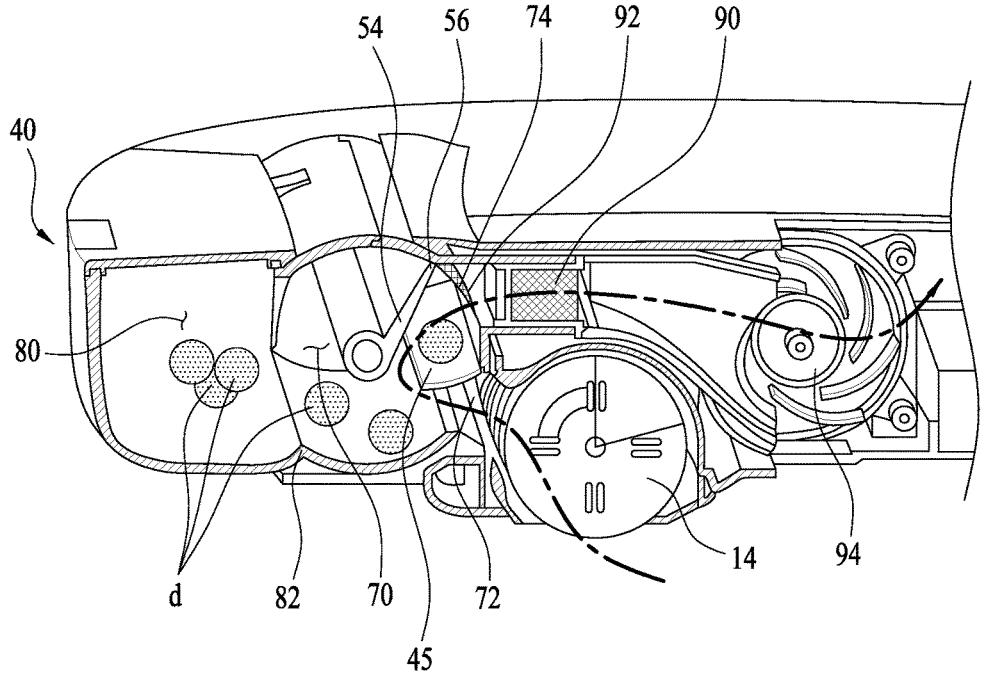
FIG. 4 is a view showing a suction generation unit in operation according to an embodiment of the present invention.

FIG. 4 is a view showing a suction generation unit in operation according to an embodiment of the present invention. Hereinafter, a description will be given below with reference to FIG. 4.

Installed at one side of the body 10 is a suction generation unit 94 to provide suction force to the dust collector 40. The suction generation unit 94 may include a fan to produce air flow. The air flow produced by the fan may be transferred to the dust collector 40.

A filter 90 is installed in an air flow path between the dust collector 40 and the suction generation unit 94 such that air without foreign substances moves from the dust collector 40 to the suction generation unit 94. As the filter 90, various types of filters including a sponge, which is capable of filtering out foreign substances, may be used.

A pre-filter 92 is installed at a portion of the filter 90 adjacent to the dust collector 40. The pre-filter 92 may filter out foreign substances of a relatively large size from the air before the air with foreign substances are moved to the filter 90. The pre-filter 92 may be formed by a mesh having a plurality of holes.

The dust collector 40 is provided with a communication hole 74 at the position where the pre-filter 92 is installed, such that air may move from the dust collector 40 to the suction generation unit 94. That is, the communication hole 74 may be covered to a predetermined degree by the pre-filter 92.

The dust collector 40 may include a first chamber 70 to primarily collect foreign substances, and a second chamber 80 communicating with the first chamber 70. Since the first chamber 70 and the second chamber 80 are not provided with a shielding member to block the inner space, foreign substances and air may freely move in the first chamber 70 and the second chamber 80.

The dust collector 40 includes a step 82 provided between the first chamber 70 and the second chamber 80 and protrudes to rise to a predetermined height. Since the step 82 shields a portion of the lower side of the section at which the first chamber 70 and the second chamber 80 communicate with each other, the foreign substances guided to the first chamber 70 may move downward in the first chamber 70 by gravity. Accordingly, once the foreign substances are moved to the second chamber 80, movement thereof back to the first chamber 70 is restricted by the step 82.

The overall inner space of the first chamber 70 may take the form of a cylinder. The plate 54 rotates in the first chamber 70, and the squeegee 56 continuously contacts the inner surface of the first chamber 70, moving the foreign substances suctioned into the first chamber 70 to the second chamber 80.

Preferably, the step 82 protrudes to form a portion of a cylindrical shape of the first chamber 70. That is, the foreign substances are preferably guided to the second chamber 80 beyond the step 82 while the plate 54 rotates to contact with the step 82.

In addition, a surface of the step 82 forming a portion of the second chamber 80 may have a greater inclination than the surface of the step 82 forming a portion of the first chamber 70. That is, once the foreign substances easily moving along the step 82 of the inner surface of the first chamber 70 are moved to the second chamber 80, they may be prevented from moving over the step 82 back to the first chamber 70.

The inner space of the second chamber 80 is preferably sealed and isolated from the outside, except the portion of the second chamber 80 communicating with the first chamber 70. The second chamber 80 is disposed such that the suction generation unit 94 is positioned farther from the second chamber 80 than from the first chamber 70. Thereby, the suction force from the suction generation unit 94 is hardly transferred to the second chamber 80. In the second chamber 80, air and foreign substances are allowed to move only through a portion of the second chamber 80 communicating with the first chamber 70, and therefore little air flow is produced in the second chamber 80.

Hereinafter, the cleaning operation of the robot cleaner will be described with reference to FIG. 4.

The robot cleaner moves along the surface to be cleaned according to rotation of the main wheels 30. At this time, the agitator 14 may also rotate to strike the surface to be cleaned. In addition, when the fan provided to the suction unit 94 is driven, floating matter or foreign substances stuck to the surface to be cleaned may be struck by the agitator 14 and suctioned into the dust collector 40 through the through hole 72.

At this time, the suctioned foreign substances d are suctioned into the first chamber 70. Part of the foreign substances d is moved to the communication hole 74 by the suction force of the suction generation unit 94. When the holes formed in the pre-filter 92 are smaller than the foreign substances d, the foreign substances d fail to pass through the pre-filter 92 and remain in the first chamber 70. Accordingly, once the air and the foreign substances smaller than the holes of the pre-filter 92 pass through the pre-filter 92, the filter 90 filters off the foreign substances and allows the air without the foreign substances to be discharged from the body 10. At this time, the dust sensor 62 may determine whether foreign substances are suctioned through the through hole 72 or the amount of the suctioned foreign substances. That is, the dust sensor 62 may perform the determination operation based on whether or not light is received or the amount of light received.

Meanwhile, as suction force is produced by the suction generation unit 94, the opening and closing member 45 opens the through hole 72. Since only the fixed end 47 of the opening and closing member 45 is coupled to the inside surface of the first chamber 70, the remaining portion of the opening and closing member 45 other than the fixed end 47 is spaced a predetermined distance from the first chamber 70. Accordingly, the foreign substances d may pass through the through hole 72. That is, when the opening and closing member 45 rotates inward of the first chamber 70 about the fixed end 47, the through hole 72 is opened.

When the suction generation unit 94 is driven, the guide member 50 is maintained at a fixed position. Particularly, the plate 54 is disposed to one side of the communication hole 74 closer to the second chamber 80. Thereby, the plate 54 does not interfere with the suctioned foreign substances d guided to the communication hole 74 (see FIG. 4).

In addition, the plate 54 shields the upper space of the dust collector 40 through which the first chamber 70 communicates with the second chamber 80, and accordingly transfer of suction force produced by the suction generation unit 94 to the second chamber 80 is restricted. Therefore, there is less movement of air and foreign substances in the second chamber 80 than in the first chamber 70. Accordingly, the foreign substances d collected in the second chamber 80 may generally be maintained in a stationary state.

Particularly, since the squeegee 56 installed at one end of the plate 54 is contacts with the inside surface of the first chamber 70, the space between the inside surface of the first chamber 70 and the plate 54 may be shielded. That is, the squeegee 56 is disposed to contact the inside surface of the first chamber 70 provided at one end of the communication hole 74.

Figure 5:
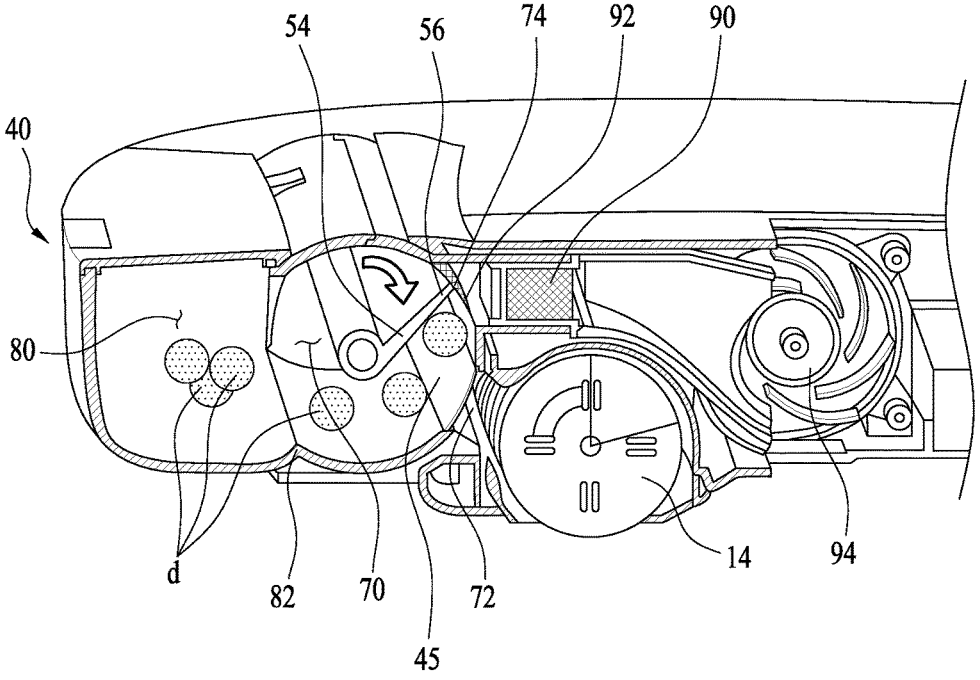
FIGS. 5 to 7 are views illustrating movement of foreign substances by a guide member according to an embodiment of the present invention.
Figure 6:
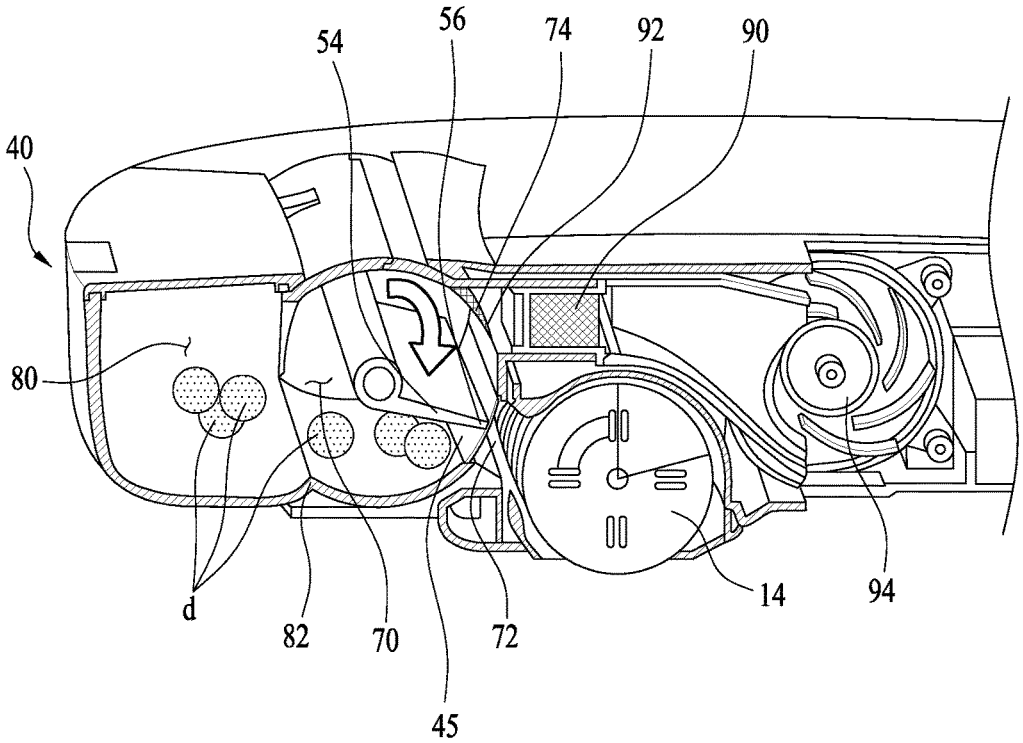
Figure 7:
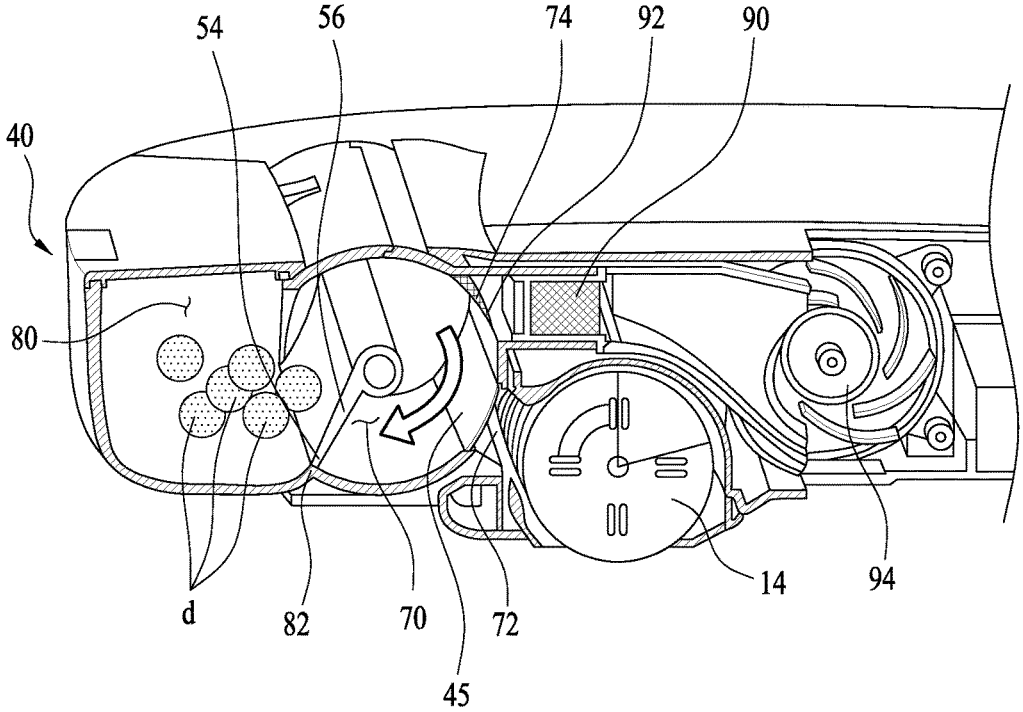

FIGS. 5 to 7 are views illustrating movement of foreign substances by a guide member according to an embodiment of the present invention. Hereinafter, a description will be given with reference to FIGS. 5 to 7.

The guide member 50 may be driven when the amount of dust measured by the dust sensor 62 exceeds a predetermined amount. That is, the dust sensor 62 continuously measures the dust passing through the through hole 72, and when a certain time elapses, the dust sensor 62 may determine that a large amount of dust has been collected.

At this time, a controller installed in the robot cleaner may cause the reducer assembly 66 to produce driving power to rotate the guide member 50.

Alternatively, the guide member 50 may be driven for a certain time period. When the user performs cleaning using the robot cleaner, a predetermined amount of foreign substances is suctioned into and accumulated in the robot cleaner after a certain time elapses. Accordingly, without calculation of information measured by the dust sensor 62, the guide member 50 may be automatically driven when a certain time elapses.

Meanwhile, when the guide member 50 is driven, the suction generation unit 94 is preferably stopped to prevent production of air flow in the dust collector 40. Since there is no suction force of the suction generation unit 94, the through hole 72 may be maintained in a closed state by the opening and closing member 45.

When the guide member 50 rotates, the plate 54 and the squeegee 56 also rotate, and the squeegee 56 contacts the pre-filter 92 installed in the communication hole 74 during movement. Accordingly, the foreign substances stuck to the pre-filter 92 are separated from the pre-filter 92 through friction with the squeegee 56. In addition, while continuously rotating along the inner circumferential surface of the first chamber 70, the squeegee 56 may separate the foreign substances stuck to the inner circumferential surface of the opening and closing member 45.

Accordingly, while the inner circumferential surface of the first chamber 70 is cleaned by the squeegee 56, the foreign substances in the first chamber 70 are removed. Thereby, air caused to move by the suction generation unit 94 may smoothly flow in the first chamber 70 when cleaning is performed again later.

Meanwhile, since the plate 54 and the squeegee 56 simultaneously rotate, the foreign substances stuck to the inside surface of the first chamber 70 and the foreign substances accommodated in the first chamber 70 move in the direction of rotation of the plate 54. Thereby, the foreign substances are guided over the step 82 to the second chamber 80 according to rotation of the plate 54 (see FIG. 7).

Since there are some foreign substances accommodated in the second chamber 80, the accommodated foreign substances may be combined with the foreign substances from the first chamber 70 to be more concentrated. Accordingly, when the same amount of foreign substances is collected in the dust collector 40, a sufficient space in the dust collector 40 for air flow may be secured since the foreign substances are compressed to a high density.

Meanwhile, the guide member 50 preferably rotates clockwise when viewed as in FIGS. 5 to 7. While rotating clockwise, the guide member 50 may contact the step 82 and move the foreign substances accommodated in the first chamber 70 to the lower side of the second chamber 80.

Figure 8:
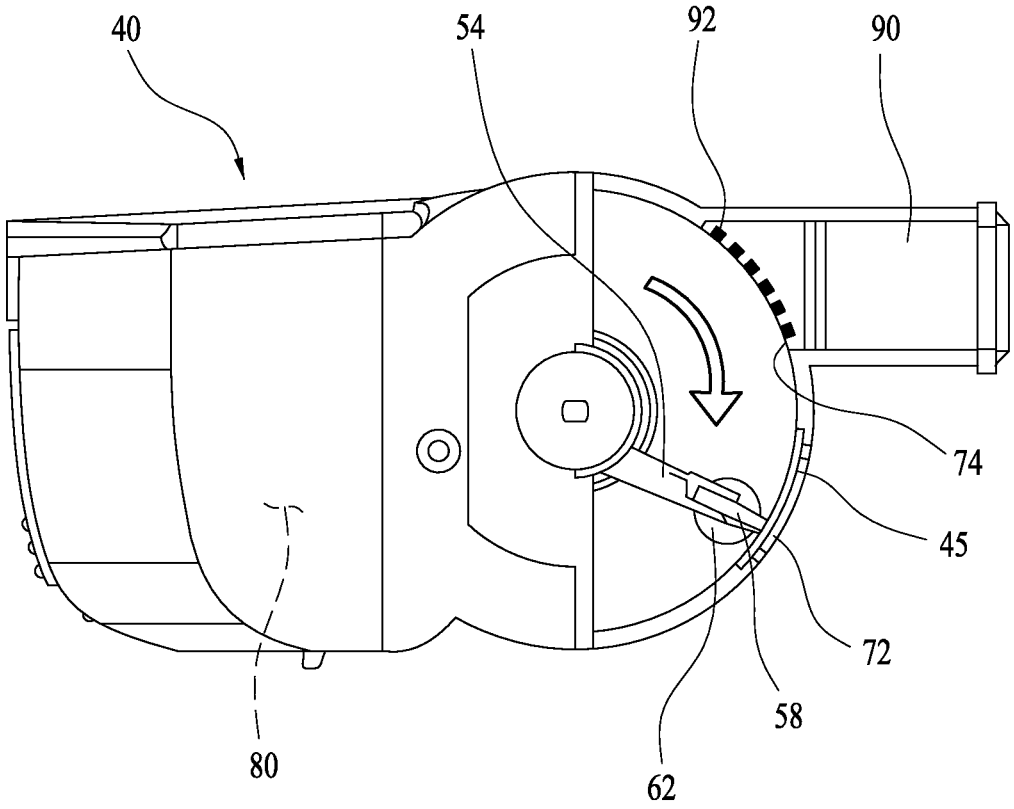
FIG. 8 is a view illustrating cleaning of a dust sensor and a pre-filter through operation of the guide member according to an embodiment of the present invention.

FIG. 8 is a view illustrating cleaning of a dust sensor and a pre-filter through operation of the guide member according to an embodiment of the present invention. Hereinafter, a description will be given with reference to FIG. 8.

The brush 58 installed at both sides of the guide member 50 rotates when the guide member 50, i.e., the plate 54 rotates.

Unlike the squeegee 56, the brush 58 contacts both sides of the inner surface of the first chamber 70 during rotation. That is, the brush 58 rotates about the rotating shaft 52, drawing a circle.

Accordingly, the dust sensor 62 contacts the sensor window 43, and thus foreign substances stuck to the dust sensor 62 may be removed. If there are foreign substances stuck to the dust sensor 62, incorrect information may be measured by the dust sensor 62. However, according to this embodiment, not only the foreign substances radially disposed on the rotating shaft 52 but also the foreign substances disposed in the longitudinal direction of the rotating shaft 52 may be moved.

Referring to FIG. 2, the user may remove the dust collector 40 from the body 10 and discharge the foreign substances accommodated in the dust collector 40 from the dust collector 40.

At this time, since a large amount of foreign substances is contained in the dust collector 40, there is a risk of the foreign substances leaking out of the dust collector 40 when the user removes the dust collector 40 from the body 10.

According to the embodiments of the present invention, however, the through hole 72 is closed by the opening and closing member 45, and therefore the foreign substances in the dust collector 40 are not discharged from the dust collector 40 through the through hole 72.

In addition, since the pre-filter 92 is installed in the communication hole 74, discharge of the foreign substances from the communication hole 74 to the outside may be prevented. Despite having a plurality of holes, the pre-filter 92 partially covers the communication hole 74. Accordingly, the foreign substances are not easily discharged through the communication hole 74, compared to the case in which a pre-filter is not provided.

In addition, according to the embodiments of the present invention, the foreign substances are compressed by the guide member 50 at a position closer to the second chamber 80, i.e., closer to the rear side of the dust collector 40. Since the density of the captured foreign substances is high, the mass of the foreign substances increases. In addition, the captured foreign substances are less likely to scatter than foreign substances of small particles. Accordingly, the captured foreign substances are less likely to escape the dust collector 40.

Particularly, the plate 54 and the squeegee 56 partially close the first chamber 70 and the second chamber 80 when they are at rest, and more foreign substances are collected in the second chamber 80 than in the first chamber 70. Therefore, the foreign substances may be prevented from discharging to the outside when the user removes the dust collector 40 from the body 10.

It may be possible for the guide member 50 to rotate 360 degrees when driven once. While rotating 360 degrees to complete one rotation, the guide member 50 may sweep the entire interior of the first chamber 70, sufficiently moving the foreign substances collected in the first chamber 70 to the second chamber 80.

Specifically, the guide member 50 preferably rotates from a predetermined initial position and returns to the initial position. Accordingly, the guide member 50 may complete at least one rotation.

As discussed above, the first chamber 70 may include a through hole 72 and a communication hole 74. The through hole 72 may be formed at the front lower side of the first chamber 70. The communication hole 74 may be formed at the front upper side of the first chamber 70. With the through hole 72 and the communication hole 74 positioned as above, the second chamber 80 may communicate with the first chamber 70 through the back of the first chamber 70.

Due to the positional relationships between the through hole 72 and the communication hole 74 in the first chamber 70 and between the first chamber 70 and the second chamber 80, a path of smooth suction flow may be created in during operation of the suction generation unit 94. That is, the inner space of the second chamber 80 may be effectively spaced apart from the path of suction flow.

Preferably, the guide member 50 is arranged so as not to interfere with the path of suction flow during operation of the suction generation unit 94. Accordingly, the initial position where the guide member 50 is located when it is not in operation is preferably predetermined. That is, the initial position is preferably a position at which the guide member 50 does not interfere with the path of suction flow.

The position of the guide member 50 shown in FIG. 4 may be the initial position. That is, the end of the plate 54 may be positioned at the upper side of the communication 74. In addition, the initial position is a position that the guide member 50 has when rotated 180 degrees from the position shown in FIG. 4.

As is apparent from the above description, the embodiments of the present invention has effects as follows.

According to the embodiments of the present invention, foreign substances collected in the dust collector may be combined with each other. Accordingly, when the same amount of foreign substances is suctioned, a large empty space may be formed in the dust collector. Accordingly, even if the dust collector is used for a long time without being frequently cleaned, smooth flow of air may be secured in the inner space of the dust collector, preventing degradation of cleaning efficiency of the robot cleaner.

In addition, according to the embodiments of the present invention, as the foreign substances suctioned into the robot cleaner interfere less with the flow path, loss of suction force may be lowered.

Moreover, since a pre-filter, which can be cleaned, is installed at the front of a filter, clogging of the filter caused by foreign substances accumulated in the filter may be prevented.

Further, according to the embodiments of the present invention, by removing the foreign substances accumulated in a dust sensor, reliability of operation of the dust sensor may be enhanced.

It will be apparent to those skilled in the art that various modifications and variations can be made without departing from the spirit or scope of the invention. Thus, it is intended that the claims cover the modifications and variations.

What is claimed is:

1. A robot cleaner comprising:

a body forming an external appearance of the robot cleaner;

a body moving part provided to the body to move the body;

a dust collector to capture suctioned foreign substances and provided with a first chamber and a second chamber communicating with the first chamber through a back of the first chamber;

a suction generation unit to supply suction force to the dust collector; and a guide member to guide the foreign substances captured in the first chamber to the second chamber and to apply pressure to the foreign substances in the second chamber in order to compress the foreign substances, wherein a through hole allowing foreign substances to be suctioned into the dust collector from an exterior of the body is formed in a front side of the first chamber and wherein a communication hole allowing introduced air to be discharged from the first chamber to the suction generation unit is formed in a front side of the first chamber, wherein the guide member comprises:

a rotating shaft, and a plate to rotate with the rotating shaft in the first chamber, wherein an overall inner space of the first chamber has a cylindrical form, and the rotating shaft is arranged in a longitudinal direction of the cylindrical form, wherein the plate is formed to extend from the rotating shaft in a radial direction or a direction of radius of the rotating shaft, and wherein the dust collector comprises a step disposed between the first chamber and the second chamber and protrudes to rise to a predetermined height, and the step forms a boundary between the first chamber and the second chamber while allowing the first chamber and the second chamber to communicate with each other.

2. The robot cleaner according to claim 1, wherein the guide member is rotatably arranged in the first chamber, and guide and pressurization of the foreign substances are performed by rotation of the guide member.

3. The robot cleaner according to claim 2, wherein a reducer assembly is provided and installed at one side of the dust collector to be coupled to the guide member, the reducer assembly to supply driving force to cause the guide member to rotate.

4. The robot cleaner according to claim 1, wherein the first chamber is provided with an opening and closing member to open and close the through hole.

5. The robot cleaner according to claim 4, wherein the communication hole is provided with a pre-filter, and a filter unit is provided between the pre-filter and the suction generation unit.

6. The robot cleaner according to claim 5, wherein the pre-filter or the communication hole is formed of a mesh having a plurality of holes.

7. The robot cleaner according to claim 6, wherein the guide member is arranged to contact the pre-filter or the communication hole when driven to rotate, so that foreign substances stuck to the pre-filter or the communication hole are separated by the contact.

8. The robot cleaner according to claim 4, wherein the first chamber and the second chamber are disposed such that the suction generation unit is closer to the first chamber than to the second chamber, wherein a continuous suction flow path is formed from the first chamber to the suction generation unit via the through hole and the communication hole.

9. The robot cleaner according to claim 1, wherein an end tip of the plate is introduced into the second chamber by rotating the rotating shaft such that the foreign substances captured in the first chamber are guided to the second chamber, and the foreign substances in the second chamber are pressurized and compressed.

10. The robot cleaner according to claim 1, wherein the first chamber is provided with a dust sensor to determine the amount of suctioned foreign substances or the amount of captured foreign substances.

11. The robot cleaner according to claim 10, wherein the guide member is configured to be driven when the amount of foreign substances measured by the dust sensor exceeds a predetermined amount.

12. The robot cleaner according to claim 10, wherein a brush to remove the foreign substances attached to the dust sensor is arranged on a lateral surface of the guide member.

13. The robot cleaner according to claim 1, wherein the dust collector is detachably mounted to a back of the body.

14. The robot cleaner according to claim 13, wherein the first chamber comprises:

a through hole formed at a front lower side of the first chamber to allow foreign substances to be suctioned into the dust collector from an exterior of the body; and a communication hole formed at a front upper side of the first chamber to allow air introduced into the first chamber to be discharged to the suction generation unit therethrough, wherein the second chamber communicates with the first chamber through a rear side of the first chamber.

15. The robot cleaner according to claim 1, wherein the guide member is driven to rotate from a predetermined initial position and return to the initial position.

* * * * *